United States Patent [19]

Harris et al.

[11] Patent Number: 4,925,242

[45] Date of Patent: May 15, 1990

[54] ADJUSTABLE LUMBAR BACK SUPPORT SYSTEM FOR A WHEELCHAIR

[75] Inventors: Godfrey Harris, Littleton; Leslie K. Hydle, Arvada, both of Colo.

[73] Assignee: Scott Orthotic Labs, Inc., Arvada, Colo.

[21] Appl. No.: 401,799

[22] Filed: Sep. 1, 1989

[51] Int. Cl.[5] ..... A47C 4/42; A47C 7/46; A61G 5/02

[52] U.S. Cl. ..... 297/284; 280/250.1; 280/304.1; 297/45; 297/DIG. 4

[58] Field of Search ..... 297/45, 284, DIG. 4; 280/250.1, 304.1

[56] References Cited

U.S. PATENT DOCUMENTS

| | | | |
|---|---|---|---|
| 2,691,410 | 10/1954 | Boucher | 297/45 |
| 2,818,910 | 1/1958 | Hawkins | 297/DIG. 4 X |
| 3,455,600 | 7/1969 | Secor et al. | 297/45 |
| 3,642,319 | 2/1972 | Berchicci | 297/284 |
| 3,663,055 | 5/1972 | Gale | 297/283 |
| 3,990,742 | 11/1976 | Glass | 297/283 |
| 4,154,232 | 5/1979 | Fukazawa | 128/52 |
| 4,295,681 | 10/1981 | Gregory | 297/284 |
| 4,350,388 | 9/1982 | Weiner | 297/284 |
| 4,541,670 | 9/1985 | Morgenstern | 297/284 |
| 4,595,232 | 6/1986 | Glenn et al. | 297/45 X |
| 4,655,471 | 4/1987 | Peek | 280/242 |
| 4,798,414 | 1/1989 | Hughes | 297/284 |
| 4,810,033 | 3/1989 | Kemmann | 297/284 |

FOREIGN PATENT DOCUMENTS

| | | | |
|---|---|---|---|
| 1122983 | 8/1968 | United Kingdom | 297/DIG. 4 |

*Primary Examiner*—Peter R. Brown
*Attorney, Agent, or Firm*—W. Scott Carson

[57] ABSTRACT

An adjustable lumbar back support system mountable across the back rest of a foldable wheelchair. The system is adjustable vertically and includes two cam members eccentrically mounted on an elongated member to selectively provide fore and aft adjustment as well as side to side adjustment. Additionally, pads can be mounted on the cam members to provide a further range of support to the system. The system provides rigidity to foldable wheelchairs and pivots out of the way when the wheelchair is collapsed. The system is also lightweight and unobtrusive and may be retrofitted to most existing styles of wheelchairs.

14 Claims, 6 Drawing Sheets

30
40
76
74
72

30
78
76
72
74
50
40
9
9
68

30
70
64
50
40
e
68

Fig. 10
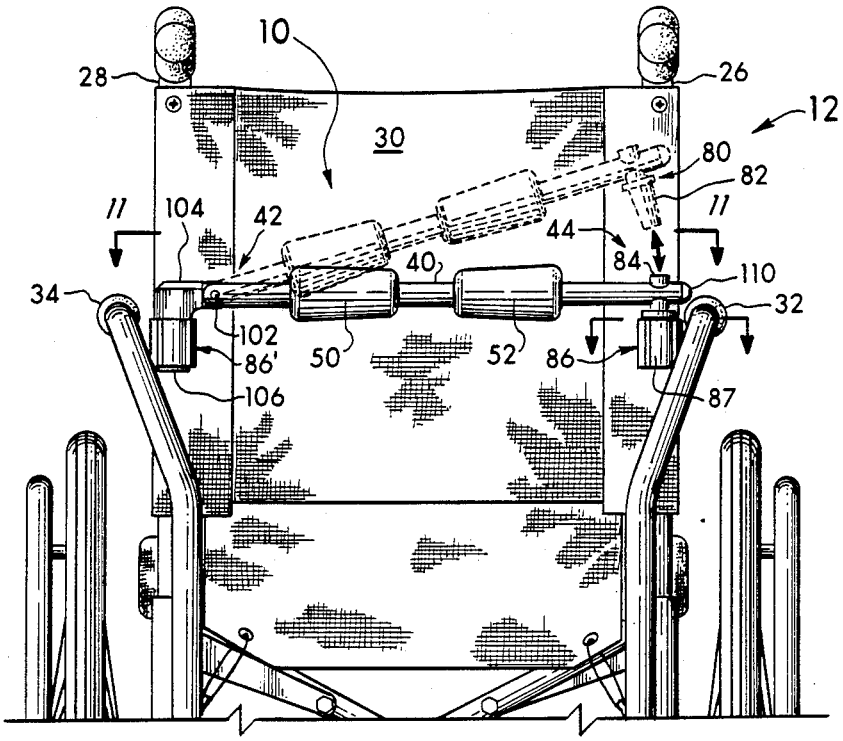
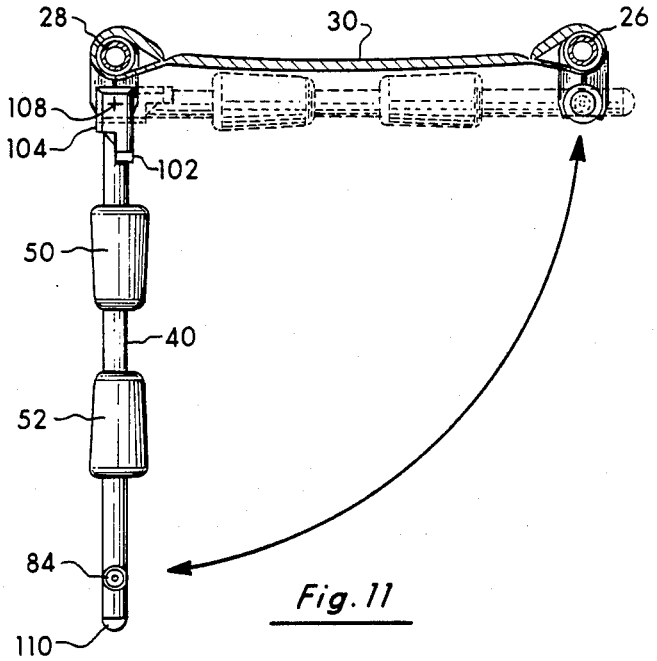
Fig. 11

ADJUSTABLE LUMBAR BACK SUPPORT SYSTEM FOR A WHEELCHAIR

BACKGROUND OF THE INVENTION

1. Field of the Invention

This invention relates to the field of adjustable lumbar back support systems for wheelchairs and more specifically, to the field of such systems for foldable wheelchairs.

2. Statement of the Problem Many people suffer from physical problems due in large part from diseases, such as osteomyelitis, and from injuries that restrict them to wheelchairs. Conventional wheelchairs, however, do not always provide adequate support to the back of the person suffering from such problems and he or she will often tend to slump forward in the chair. This not only reduces the lung capacity of the individual but also often causes more discomfort to the occupant and forces additional weight onto the front of the chair creating a potentially dangerous imbalance in the wheelchair.

Conventional wheelchairs do not have the capability to adjust the back support of the wheelchair to the individual needs of the wheelchair occupant. Depending on the severity of the problem and the physical characteristics of the person, each individual may require not only a different amount of pressure from the back support of the wheelchair but also at a different location along his or her back. Yet, no such adjustable support system is presently available in conventional chairs.

Another current problem with wheelchairs, particularly foldable ones, is that they lack rigidity across the back rest. That is, many popular wheelchairs are designed to be foldable in order to be easily transportable and stored. Typically, the back rest and seat of these chairs are flexible and fold so the chair can be collapsed by pushing the sides of the wheelchair together. However, these chairs often lack rigidity across the back which can aggravate the back support problem in that the weight of the occupant acting on the flexible seat and back rest may cause the back of the chair to flex causing the occupant to undesirably move his or her shoulders forward into a slumping posture.

Prior attempts to remedy these problems utilized bulky back supports built internally into the wheelchair back rest in rigid chairs. These prior back supports do not provide a wide range of adjustability nor do they allow for use on a foldable chair. These supports also often add significant weight to the chair which can adversely affect its balance.

Consequently, there exists a need for a device which will provide back support to a wheelchair occupant according to the individual needs of the occupant and is mountable on a foldable wheelchair.

Solution to the Problem

The current invention solves these problems and others by providing a lumbar back support system which is adjustable to fit the individual requirements of the occupant of the wheelchair. Additionally, the back support system is mountable on a wheelchair in such a way that the capability of the wheelchair to be folded is not impeded.

SUMMARY OF THE INVENTION

The current invention provides a back support system mountable across the rear of the back rest of a wheelchair, particularly a foldable wheelchair. The system is designed to be adjustable vertically on the wheelchair as well as fore and aft and side to side to fit the particular needs of a wide range of individuals. The system includes two back support cam members eccentrically mounted on an elongated member to selectively provide the fore and aft adjustment. Additionally, the cam members are adjustable side to side on the elongated member to adjust their horizontal spacing relative to one another across the back. Pads can also be mounted if desired on the cam members to provide a greater range of adjustability to the system.

The cam members are mounted on the elongated member which is pivotally mounted to one of the back posts of the wheelchair. The elongated member is releasably secured to the other back post in a horizontal position. When it is desired to fold the chair, the elongated member is disengaged from the second back post and pivoted downwardly out of the way to allow the back rest and seat to be folded and the chair collapsed. When the chair is fully extended again, the elongated member can be pivoted upwardly to its horizontal position and secured to the second back post.

The system further provides rigidity to the foldable wheelchair, locking the flexible back rest in place. This prevents the back rest from partially collapsing from the weight of the occupant. In this manner, the occupant has less tendency to slump forward and the shoulders of the occupant remain naturally retracted so the weight of the occupant is better centered on the chair. Additionally, the system is designed to be lightweight so as not to affect the overall balance of the chair. The system is also unobtrusive when installed and can be retrofitted to a wide range of sizes and styles of wheelchairs.

BRIEF DESCRIPTION OF THE DRAWINGS

FIG. 10 is a rear view of the invention initially being disengaged from the securing clamp.

FIG. 11 is a view along line 11—11 of FIG. 10 showing the movement of the elongated member of the invention horizontally away from the back rest of the chair.

DETAILED DESCRIPTION OF THE INVENTION

Figure 1:
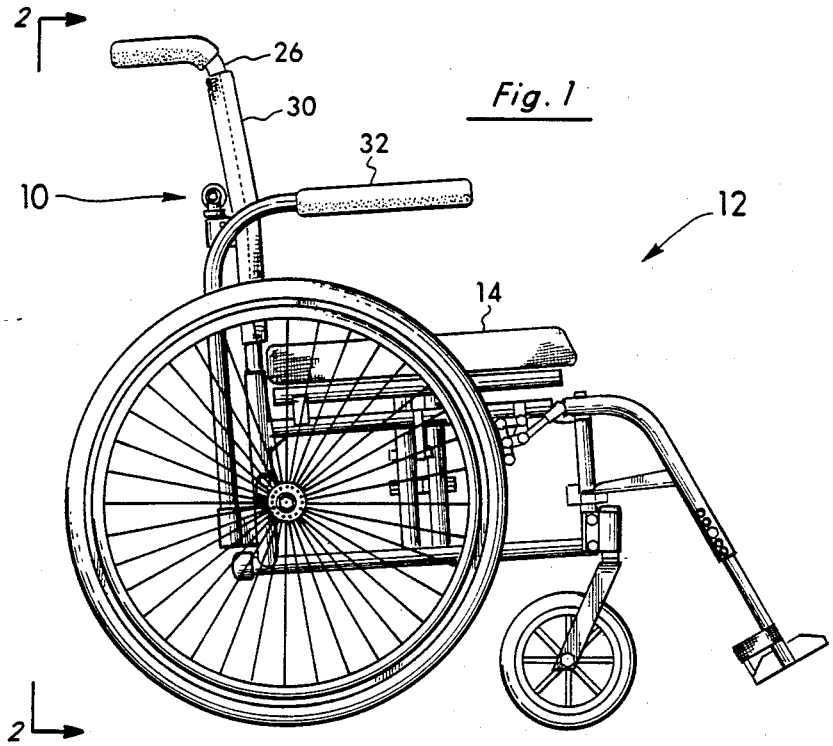
FIG. 1 is a side view of the invention mounted on a typical wheelchair.
Figure 2:
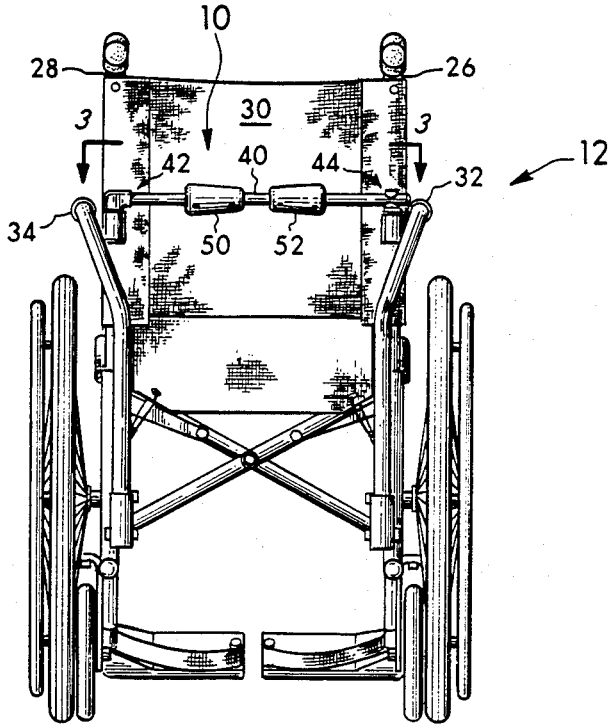
FIG. 2 is a rear view of the wheelchair and invention taken along line 2—2 of FIG. 1.

The preferred embodiment of the lumbar back support system 10 of the current invention is shown mounted on a typical wheelchair 12 in FIGS. 1 and 2. The wheelchair 12 is designed to be folded (see FIG. 12) so as to be easily transportable and stored. The wheelchair 12 includes a seat 14 (see FIG. 1) formed of a flexible material, two vertically extending back posts 26, 28 (see FIG. 2) spaced apart from each other, and a back rest 30 formed of a flexible material attached to the spaced back posts 26, 28. Arm supports 32, and 34 are also provided as shown. In regard to wheelchair 12, the current invention is shown only for illustrative purposes with this particular wheelchair as the system 10 is designed and is suitable for use with a wide range of sizes and styles of wheelchairs and other orthopedic devices.

The preferred embodiment of the current invention is illustrated in FIGS. 1–13. As shown in FIGS. 1 and 2, the lumbar back support system 10 is mounted across the outside of the wheelchair back rest 30 on the side opposite from the wheelchair occupant (i.e., on the left side in FIG. 1). The system 10 includes an elongated member 40 (see FIG. 2) which extends substantially horizontally when the system 10 is in its secured position of FIG. 2. The elongated member 40 has a first end portion 42 and a second end portion 44. In the preferred use, the elongated member 40 is pivotally secured to the upright back post 28 at end portion 42 and removably secured to the upright back post 26 at end portion 44.

The system 10 (see FIG. 2) provides two lumbar back support members 50, 52 mounted on the elongated member 40. These back support members 50, 52 are cams formed in the shape of truncated cones having their bases 54, 56 (see FIG. 3) facing away from each other and the narrowing portions 58, 60 of the cones extending toward each other. The cams 50, 52 have cylindrical holes 62 (see FIG. 5) extending lengthwise through them through which the elongated member 40 extends. As shown, the holes 62 are formed offset from and parallel to the central longitudinal axis of the cams. In this manner, the cams 50, 52 are thus eccentrically mounted on the elongated member 40. The cams are also designed to slide along and rotate about the elongated member 40. In this regard, set screws 66 (see FIG. 3) are provided to lock the cams in their desired positions on the member 40.

Figure 3:
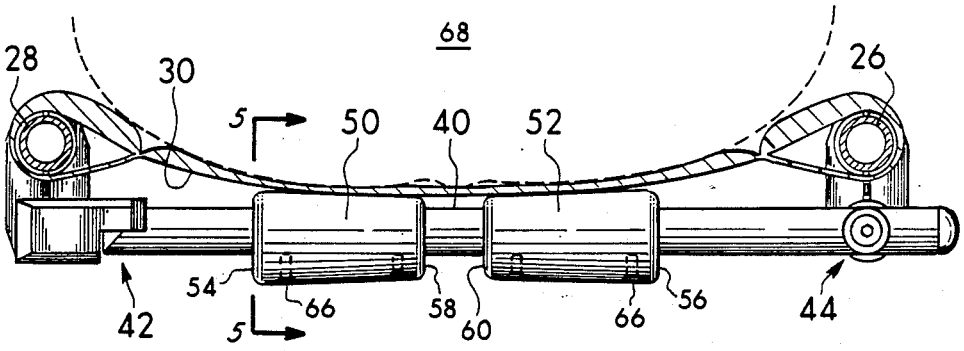
FIG. 3 is a top view of the invention taken along line 3—3 of FIG. 2.
Figure 4:
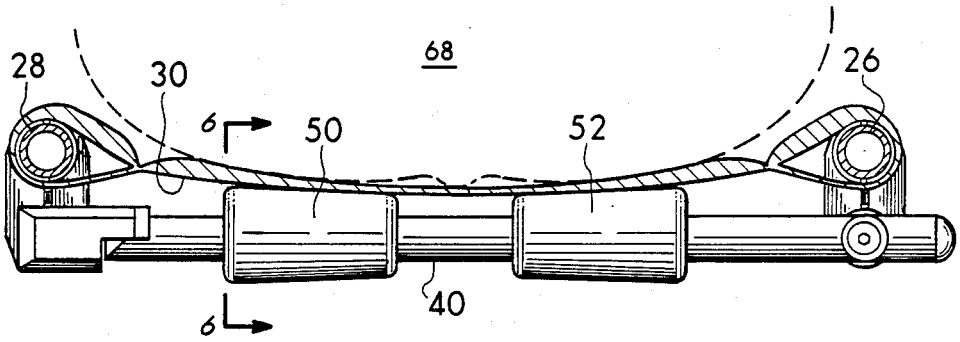
FIG. 4 is a top view of the invention adjusted to a second support position.
Figure 6:
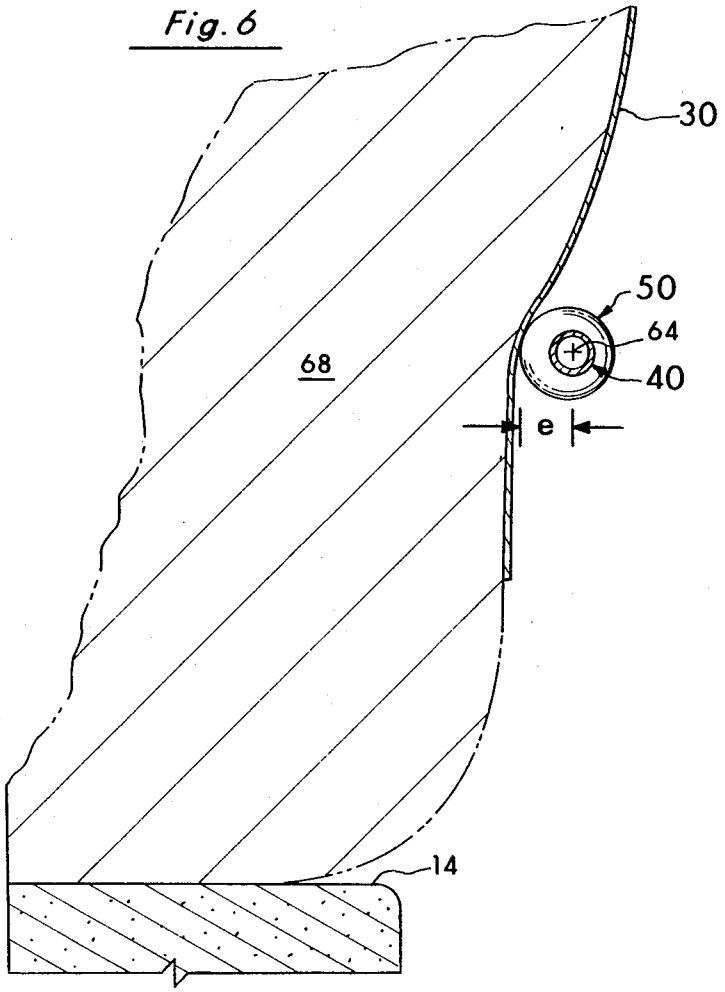
FIG. 6 is a side view along line 6—6 of FIG. 4.
Figure 5:
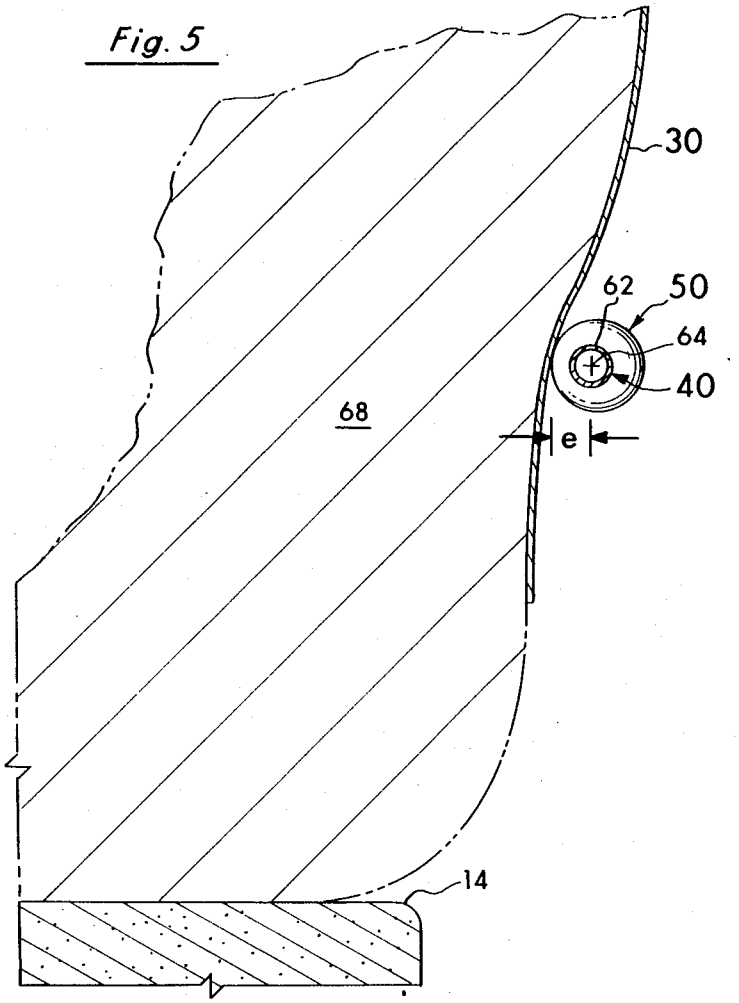
FIG. 5 is a side view along line 5—5 of FIG. 3.

As illustrated in FIGS. 3–6, the selective movement of the eccentrically mounted cams 50, 52 adjusts the degree of support to the back of the person 68 occupying the wheelchair. In this respect, the elongated member 40 is secured in a horizontal position across the back rest 30 so the cams contact the back rest 30 when the occupant 68 is seated in the chair. As the cams 50, 52 are rotated about the elongated member 40 (i.e., compare the positions of FIGS. 3 and 4), the distance between the back rest 30 and the elongated member 40 changes, thus varying the pressure on the back of the wheelchair occupant 68. The cams in FIGS. 3 and 5 are adjusted so the distance, 'e', in FIG. 5 between the first or longitudinal axis 64 of the elongated member 40 and the backrest 30 is the least. This, in turn, corresponds to the eccentric positioning of least pressure on the occupant's back. Thereafter, the set screws 66 can be loosened and the cams rotated 180 degrees as in FIGS. 4 and 6 so the distance, 'e', is the greatest which corresponds to the eccentric positioning of most pressure on the occupant's back. The cams 50, 52 can provide further adjustment by varying the longitudinal spacing between them. For example, the cams in FIG. 4 could be adjusted along the longitudinal axis 64 of member 40 to reduce the relative spacing between them and to increase the pressure on the back of the occupant 68. In this manner and for maximum support, the cams 50, 52 would then be adjusted so as to be eccentrically positioned as in FIG. 4 and spaced close together as in FIG. 3.

In practice, the adjustment of the cams 50, 52 allows the support system 10 to be set according to the individual requirements of the occupant of the wheelchair. This is dependent on the severity of the medical problem, the length of time the problem has existed, the skin pressure tolerance of the individual, the curvature of the spine, and other individual factors. The cams 50, 52 can also be individually offset or rotated relative to each other so that virtually any particular needs of the wheelchair occupant can be met. The ability to adjust the spacing of the cams individually as well as adjusting the relative spacing and fore and aft adjustment enables the support system 10 to be used with individuals having very special needs.

Figures 7, 8, 9:
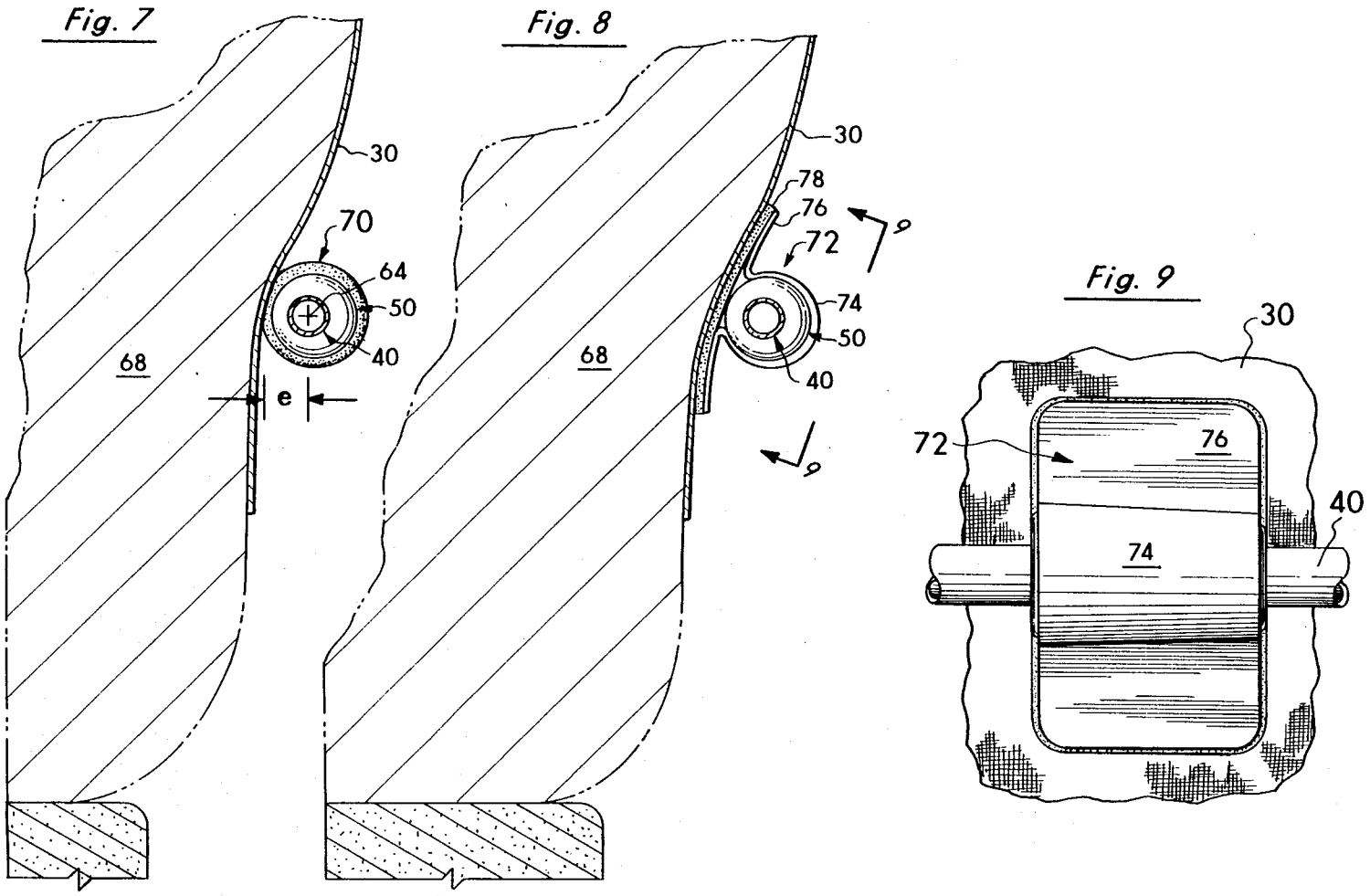
FIG. 7 is a side view of a cam member with a pad mounted thereto.
FIG. 8 is a side view of a cam member with a planar support pad mounted thereto.
FIG. 9 is a view of the planar support pad along line 9—9 of FIG. 8.

To provide an even greater range of adjustment for the support system, pads may be mounted over the cams 50, 52. One such pad 70 is illustrated in FIG. 7. This pad is formed of a resilient, cylindrical tube. As the pad 70 is mounted over the cam 50, it deforms to a cone shape, matching the shape of the cam member 50 and increasing the distance 'e', thus increasing the support pressure. This pad 70 also adds a greater degree of cushioning to the support.

Another type of pad 72 is illustrated in FIGS. 8 and 9. This pad has a conically shaped cylindrical portion at 74 (see FIG. 9) matching the cam member 50 and a substantially planar portion 76 to which a foam pad 78 is attached by adhesive. This pad 72 contacts the back rest 30 of the chair to spread support pressure over a greater area of the back of the wheelchair occupant. In operation, the pad 72 can be slipped over the cam member 50, the cam member rotated about and moved along the elongated member 40 until the desired position is selected, and then holes formed in the pad portion 74 in order to reach and tighten the set screws 66 (see FIG. 3) to lock the system in place. An alternative procedure would be to place the pad 72 on the cam 50, position the cam 50 in place, remove the pad 72, tighten the set screws 66, and then replace the pad 72 on the cam 50.

The system 10 is designed to be easily adjusted vertically in order to precisely support the lumbar apex of the wheelchair occupant 68. In doing so, the system 10 is positioned on the back posts 26, 28 of the wheelchair at the desired height. It is then clamped by clamps of the type 86 illustrated in FIG. 13 and discussed below to lock the system 10 at the selected height.

The elongated member 40 is removably secured to the back post 26 by latch member 80 (see FIG. 10). The latch member 80 includes a tapered pin portion 82 and a clamping screw 84 (see FIG. 11) which clamps the latch member 80 onto the second end portion 44 of the elongated member 40. The pin 82 of latch member 80 is inserted into bushing 87 (FIGS. 10 and 13) which is clamped to the back post 26 by spring clamp 86 illustrated in FIG. 13. The spring clamp 86 includes a first piece 88 having concave portions formed on each end, a second piece 90 having matching concave portions on each end, and clamping screw or screws 92 securing the two pieces together. One end portion clamps to the back post 26 and the other end portion clamps the bushing 87. In order to fit the system 10 to a range of back post sizes, spacers 100 are used to insure the clamps 86 are tightened on equal diameters on each clamp end.

In the preferred embodiment, the system 10 is designed to be used on a foldable wheelchair without impeding the ability of the chair to be easily folded. To this purpose, the elongated member 40 is designed to be easily released from the first position secured to the back post 26 (see FIG. 2) and moved to a second position out of the way of the folding of the wheelchair (see FIG. 12). In doing so, the elongated member 40 is pivotally mounted at 102 (see FIG. 10) on its first end portion 42 to a support bracket 104. The support bracket 104 is mounted to the back post 28 by a two-piece clamp 86' of the type illustrated in FIG. 13 and discussed above. One end of the clamp 86' clamps to the back post 28 of the wheelchair. The other end of the clamp secures bushing 106 on which the support bracket 104 is mounted for pivotal movement about a vertical axis 108 away from the back rest 30. The elongated member 40 is thus able to pivot in a vertical plane about axis 102 (as shown in dotted lines in FIG. 10) as well as pivot in a horizontal plane about axis 108 as shown in FIG. 11.

Figure 12:
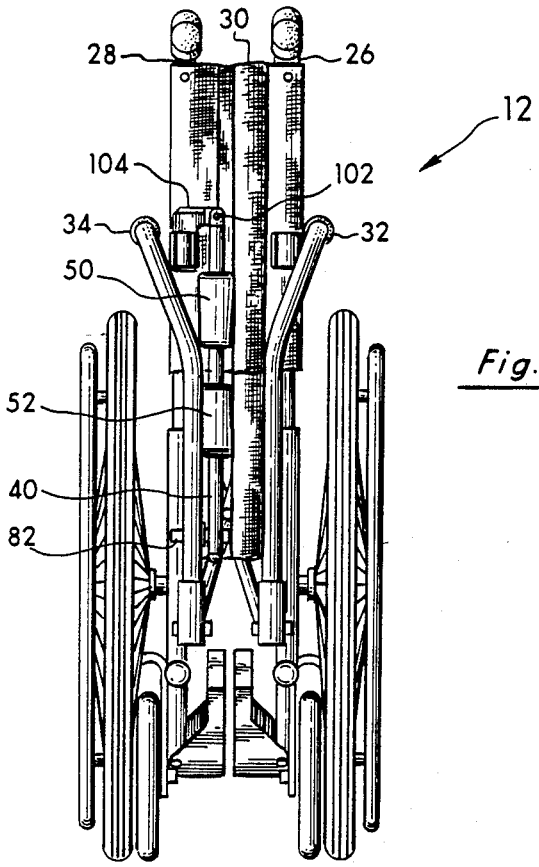
FIG. 12 is a rear view of the wheelchair folded and the elongated member tucked out of the way.
Figure 13:
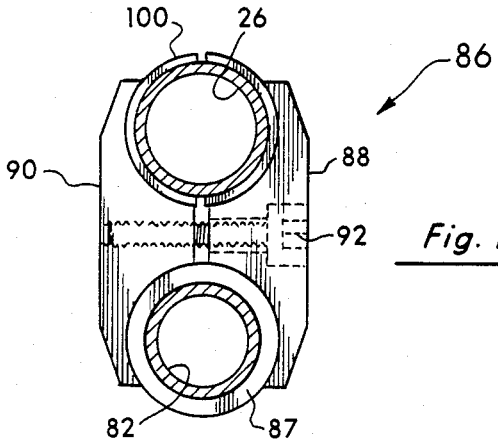
FIG. 13 is an enlarged view of the securing clamp taken along line 13—13 of FIG. 10.

This pivotal movement enables the back support system 10 of the present invention to be moved out of the way when the chair is to be folded. That is, as shown in FIGS. 10–13, the elongated member 40 can be pivoted upwardly to release its end portion 44 from being secured in clamp 86 (FIG. 10), rotated away from the back rest 30 (FIG. 11), and then pivoted downwardly (FIG. 12) with the axis of the elongated member 40 substantially parallel to and adjacent the vertical axis of the upright back post 28. The sides of the wheelchair 12 can then be folded together to collapse the wheelchair. At this point, as shown in FIG. 12, the portion 82 of the latch pin 80 is secured between lower portions of the arm rest 34 and back post 28 to hold the elongated member 40 in an out of the way position. To re-engage the system 10, the chair is unfolded, the elongated member 40 pivoted upwardly and rotated in position and the portion 82 of the latch pin 80 secured in the bushing 87 of clamp 86.

The lumbar back support system 10 is designed to be retrofitted to a variety of wheelchair styles and sizes and to be adjusted to fit differing sizes of individuals with differing types of requirements. In this regard, the system can be initially provided with an oversize elongated member 40 which can then be cut to the proper length according to the width of the chair on which it is to be mounted. A dome plug 110 (see FIG. 11) is then inserted in the cut end of the member 40. As discussed above, the spacers 100 (see FIG. 13) are provided with diameters to fit the back posts of most wheelchairs so the clamps 86 and 86' will always clamp the same diameter as the bushings 87 and 106.

The installation procedure for the lumbar back support system 10 on a wheelchair is simple and easy. In doing so, the lumbar apex of the wheelchair occupant 68 is first determined by measuring the occupant seated in the chair. The back rest 30 is then slit at the proper height on both back posts 26, 28. The two clamps 86 and 86' are thereafter provided with the appropriate spacers 100 and attached to the exposed back posts 26, 28 (FIG. 10) with the respective bushing 87 and 106. The support bracket 104 is then mounted on the bushing 106 and the first end portion 42 of the elongated member 40 is pivotally mounted to the support 104 at 102. The length of the elongated member 40 is determined to match the width of the wheelchair and cut to length after which the dome plug 110 is inserted in the cut end of the elongated member 40. The latch pin 80 is then mounted on the second end portion 44 of the elongated member 40. The clamps 86 and 86' may be pivoted slightly about the back posts to precisely fit the portion 82 of the latch pin 80 to the bushing 87 and then tightened to lock the clamps on the chair. The lumbar support cams 50, 52 are then adjusted by sliding them along and rotating them about the elongated member 40 until the needs of the wheelchair occupant 68 are met after which they are locked in place by the set screws 66. As discussed above and with the elongated member 40 secured at each end portion 42 and 44, it adds rigidity to the chair by maintaining the upright back posts 26, 28 apart at a fixed distance.

The lumbar back system 10 is designed to be lightweight so it does not adversely affect the overall balance or operation of the wheelchair. Additionally, the elongated member 40 does not interfere with the operation of the chair or the folding of collapsible chairs. In use, the system 10 is unobtrusive when installed and follows the lines of the wheelchair design.

While several embodiments of the present invention have been shown and described in detail, it is to be understood that various changes and modifications could be made thereto without departing from the scope of the invention.

We claim:

1. An adjustable back support system for use with a wheelchair, said wheelchair having a flexible back rest extending between two upright back posts and said system providing adjustable support for the lumbar region of the back of the wheelchair occupant, said support system including:

an elongated member extending along a first axis and means for mounting said elongated member to said wheelchair with the first axis thereof substantially horizontal and with said elongated member extending substantially across the flexible back rest of said wheelchair between said two upright back posts and on the opposite side of said back rest from the wheelchair occupant, and at least two cam members eccentrically mounted about said elongated member and means for adjustably positioning each of said cam members about and along said elongated member, said positioning means including means for selectively varying the position of each eccentric cam member about the first axis of said elongated member to selectively increase and decrease the lumbar support provided to the wheelchair occupant, said positioning means further including means for selectively varying the position of each cam member along the first axis of said elongated member relative to each other and to said elongated member to provide additional adjustability to the lumbar support provided to the wheelchair occupant.

2. The support system of claim 1 further including means for vertically adjusting the position of said elongated member relative to the back posts and flexible back rest of said wheelchair to allow the placement of the elongated member and the first axis thereof at any desired height relative to the back posts and back rest.

3. The support system of claim 2 wherein said vertical adjusting means includes means for removably securing said elongated member to said back posts.

4. The support system of claim 3 wherein said removable securing means includes clamps and means to selectively secure said clamps to said back posts at any desired height.

5. The support system of claim 1 wherein said elongated member has first and second end portions spaced from each other along said first axis and said mounting means includes means for pivotally mounting said first end portion to said wheelchair adjacent one of said back posts and means for releasably securing said second end portion to said wheelchair adjacent the other back post wherein said second end portion of said elongated member can be released from said wheelchair and said elongated member pivoted about said first end portion thereof relative to said wheelchair.

6. The support system of claim 5 wherein said one back post extends substantially vertically along an axis and said pivotal mounting means mounts said elongated member for pivotal movement about said first end portion at least from a first position with the first axis of said elongated member substantially horizontal to a second position with the first axis thereof substantially vertical and adjacent to the axis of said one back post.

7. The support system of claim 6 wherein said wheelchair is foldable by moving said two upright back posts toward each other to a folded position with said elongated member in said second position.

8. The support system of claim 1 wherein said cam members are truncated cones with the bases of said cones facing away from each other and the narrowing portions of the cones extending toward each other.

9. The support system of claim 8 further including a substantially cylindrical pad mounted about each conical cam member.

10. The support system of claim 8 further including a pad mounted on each cam member wherein each pad has a substantially planar portion contacting said flexible back rest of said wheelchair.

11. In a foldable wheelchair having a flexible back rest extending between two upright back posts, said wheelchair being movable between an open position with said back posts substantially parallel and spaced a first distance from each other and a folded position with said back posts spaced a second, closer distance from each other, the improvement including:

rigidity means to maintain said back posts spaced said first distance from each other in said open position of said wheelchair to add support rigidity to the wheelchair, said rigidity means including an elongated rigid member extending along a first axis and means for mounting said elongated member to said wheelchair with the first axis thereof substantially horizontal and with said elongated member extending substantially across the flexible back rest of said wheelchair between said two upright back posts and on the opposite side of said back rest from the wheelchair occupant, said elongated member having first and second end portions spaced from each other along said first axis and said mounting means including means for pivotally mounting said first end portion to one of said back posts of said wheelchair and means for releasably securing said second end portion to the other back post of said wheelchair wherein said second end portion of said elongated member can be released from said other back post and said elongated member pivoted about said first end portion thereof relative to said one back post, said one back post extending substantially vertically along an axis and said pivotal mounting means mounting said elongated member for pivotal movement about said first end portion at least from a first position with the first axis of said elongated member substantially horizontal and said elongated member rigidly maintaining said back posts apart at said first distance to a second position with the first axis of said elongated member substantially vertical and adjacent to the axis of said one back post wherein said wheelchair can be folded by moving said two upright back posts toward each other to said folded position with said elongated member in said second position, and at least two cam members eccentrically mounted about said elongated member and means for adjustably positioning each of said cam members about and along said elongated member, said positioning means including means for selectively varying the position of each eccentric cam member about the first axis of said elongated member to selectively increase and decrease the back support provided to the wheelchair occupant, said positioning means further including means for selectively varying the position of each cam member along the first axis of said elongated member relative to each other and to said elongated member to provide additional adjustability to the back support provided to the wheelchair occupant.

12. The improvement of claim 11 further including means for vertically adjusting the position of said rigid, elongated member relative to the back posts and flexible back rest of said wheelchair to allow the placement of the elongated member and the first axis thereof at any desired height relative to the back posts and back rest.

13. The improvement of claim 12 wherein said vertical adjusting means includes means for removably securing said elongated member to said back posts.

14. The improvement of claim 13 wherein said removable securing means includes clamps and means to selectively secure said clamps to said back posts at any desired height.

* * * * *